United States Patent [19]

Knipp

[11] 4,041,886

[45] Aug. 16, 1977

[54] TIME LAPSE STEERING CONTROLS FOR SELF PROPELLED MODELS

[76] Inventor: Francis Knipp, 2009 Marshall St., Manitowoc, Wis. 54220

[21] Appl. No.: 648,924

[22] Filed: Jan. 14, 1976

[51] Int. Cl.[2] ..... B63H 25/00

[52] U.S. Cl. ..... 114/144 R; 46/250; 46/252

[58] Field of Search ..... 114/144 R, 144 C; 244/76 R, 82, 179; 200/34; 318/588; 46/248, 252, 268, 250, 93

[56] References Cited

U.S. PATENT DOCUMENTS

| | | | |
|---|---|---|---|
| 1,620,709 | 3/1927 | Young | 114/144 R |
| 3,600,851 | 8/1971 | Nielsen | 46/252 |
| 3,717,952 | 2/1973 | Strongin | 46/252 |

*Primary Examiner*—Stephen G. Kunin
*Assistant Examiner*—Jesus D. Sotelo

[57] ABSTRACT

This invention relates to a time lapse steering control for models of the type which causes a self propelled model car, boat, or airplane to alter its course of travel after a certain preset period of time has elapsed. In one embodiment of the invention this is accomplished by using a patented air bleed timer which serves three functions:

1. It determines at what point in time the course of travel will be altered;
2. It determines the extent of the turn; and
3. It provides the propelling force which moves a cam past a cam follower. The cam follower in turn actuates the linkage which is coupled to the steering member of the model.

13 Claims, 17 Drawing Figures

FIG. 3
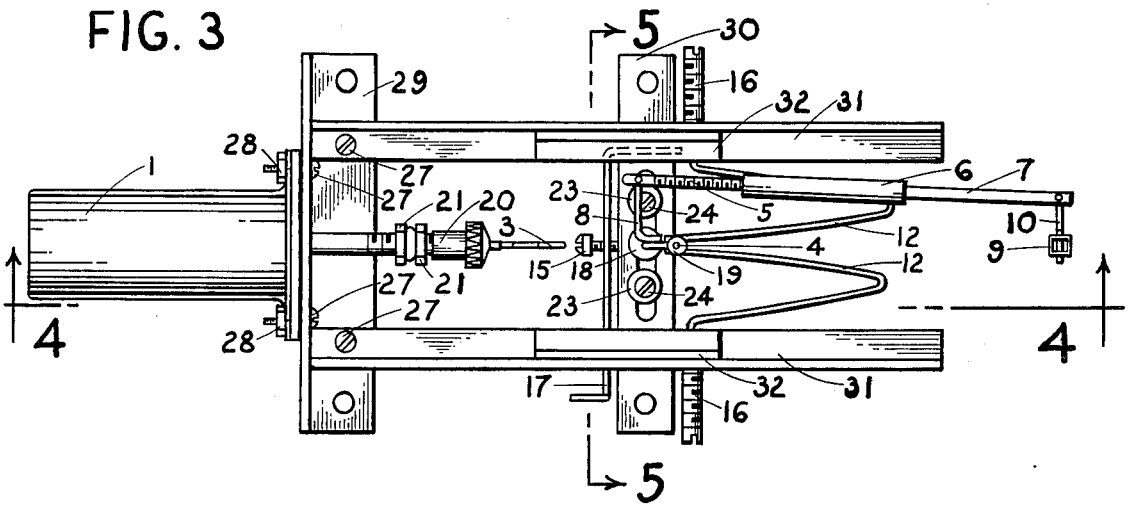
FIG. 4
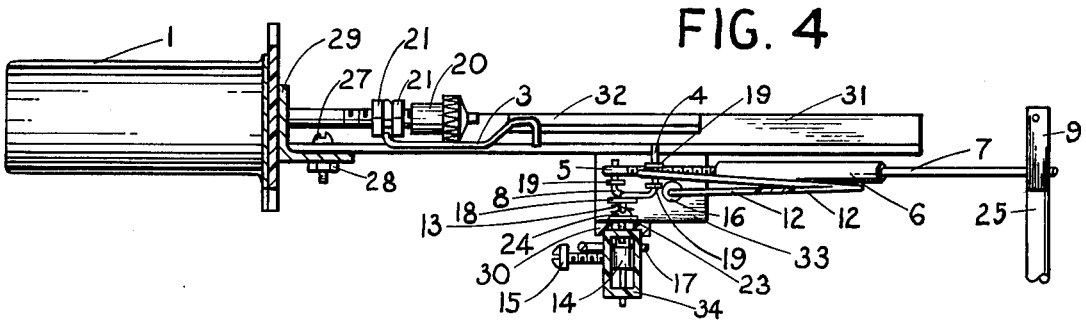
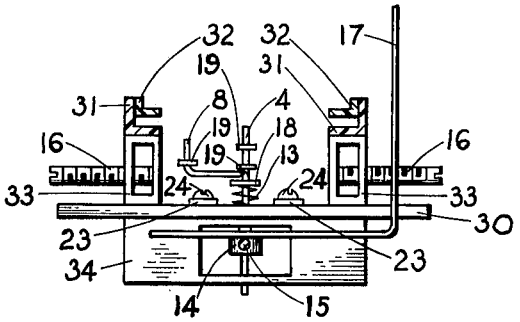
FIG. 5
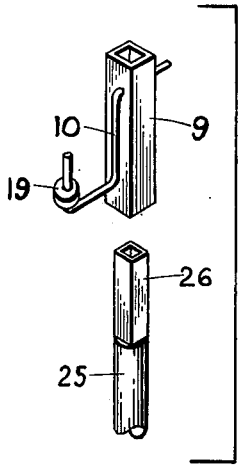
FIG. 6
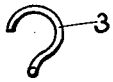
FIG. 8
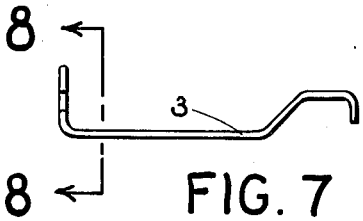
FIG. 7

FIG. 10
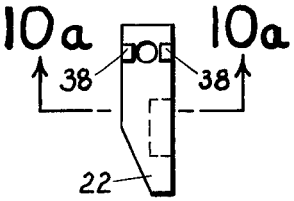
FIG. 9
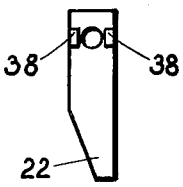
FIG. 10a
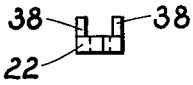
FIG. 9a
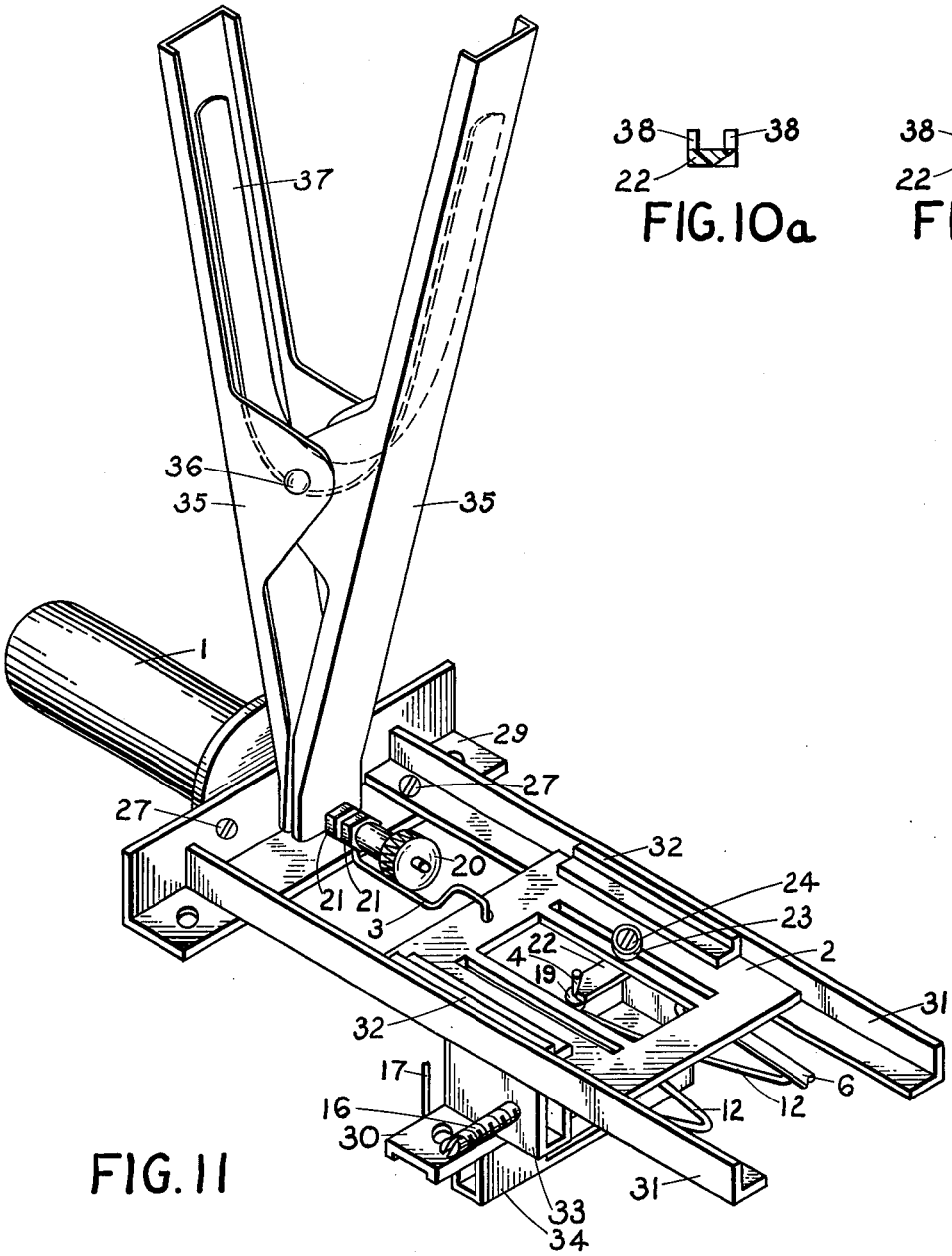
FIG. 11

FIG. 12
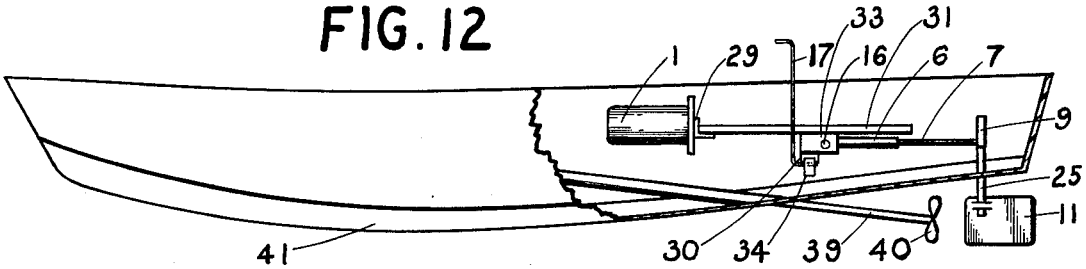
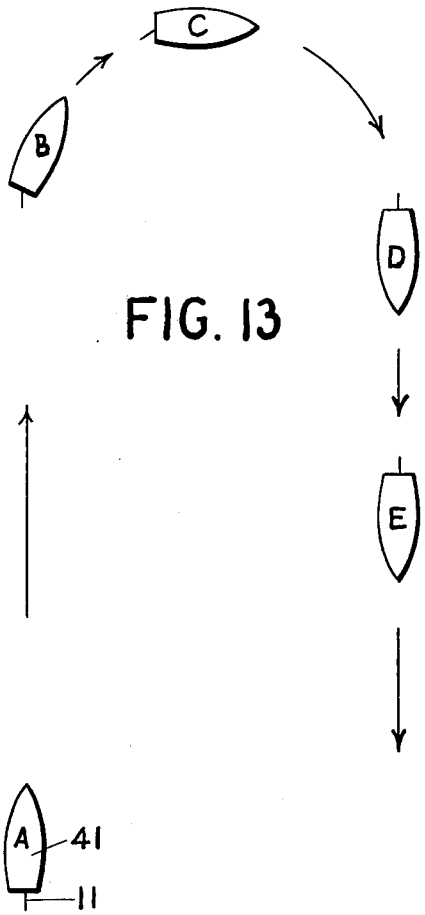
FIG. 13
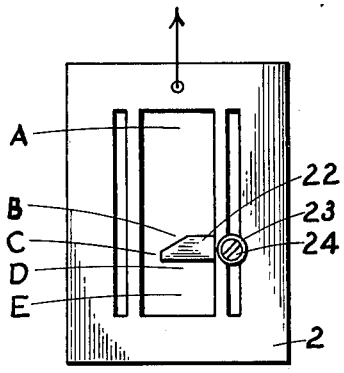
FIG. 13a
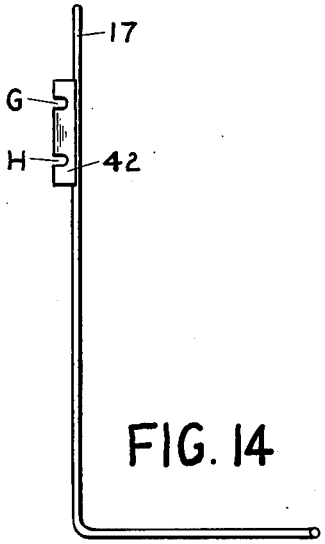
FIG. 14

TIME LAPSE STEERING CONTROLS FOR SELF PROPELLED MODELS

SUMMARY OF THE INVENTION

This invention relates to a time lapse steering control for self propelled model cars, boats, or airplanes. The intent is to manufacture the time lapse steering control as a unit which a model builder could incorporate into his own model.

The unit would cause a model to execute a turn or series of turns after a certain preset period of time has elapsed. The time interval before the turn, during the turn, and between turns is variable depending on the desires of the operator of the model.

Unlike the prior art, this invention makes use of a spring loaded dashpot to act as a timer to determine when the turn sequence should occur and the extent of the turn, and to provide the power to actuate the steering means of the model via a cam and its associated linkage. This system provides asteering control unit which is independent of and separate from the propelling means of the model. It is also a unit which is simple in concept and manufacture, and easily adaptable to use in a variety of self-propelled models.

In the drawings and description which follows, the time lapse steering control device is shown as it would be adapted to use in a boat model. However, it is recognized that it would also be suitable for use in model cars, and airplanes as well.

BRIEF DESCRIPTION OF THE DRAWINGS

FIG. 3 is a top view showing the complete steering control unit with the exception of the cam plate and cam.

FIG. 4 is a sectional side view taken along line 4—4 of FIG. 3.

FIG. 5 is a section view taken along line 5—5 of FIG. 3.

FIG. 6 is a perspective exploded view of the rudder shaft which shows one method of joining the lever arm thereto.

FIG. 7 is an enlarged side view of the hook used to link the air bleed timer to the cam plate.

FIG. 8 is an enlarged view of the hook shown in FIG. 7, taken along line 8—8 of FIG. 7. FIG. 9 is an enlarged top view of one embodiment of the cam.

FIG. 9*a* is an enlarged end view of the cam shown in FIG. 9.

FIG. 10 is an enlarged top view of a second embodiment of the cam.

FIG. 10*a* is an enlarged section view of the second embodiment of the cam taken along line 10*a* —10*a* of FIG. 10.

FIG. 11 is a perspective view of the invention showing the pronged lever tool used in cocking the timer.

FIG. 12 is a side view of a boat having a portion of the hull broken away to reveal the steering control unit therein.

FIG. 13 is a top view showing the course of travel which a boat having the cam configuration shown in FIG. 13*a* would follow.

FIG. 13*a* is a top view of the assembled cam and cam plate. The lettered points indicate the locations of the cam follower relative to the cam at the times corresponding to the positions of the boat in its course of travel shown in FIG. 13.

FIG. 14 is an end view of the detent lever showing the two locked positions into which it can be placed.

DESCRIPTION OF THE PREFERRED EMBODIMENTS

Timer and Regulating Valve

The turning mechanism is actuated through the use of an air bleed timer 1. This timer is in effect a spring loaded dash-pot having an orifice. This orifice is equipped with a valve 20, which determines the rate at which air is bled from the timer. The timer 1, used and preferred in this steering control is itself a patented device having U.S. Pat. No. 2,207,189. However, it is recognized that any one of many dashpot type devices containing a fluid or a substance possessing a high degree of plasticity could be used.

Opertion

Figure 1:
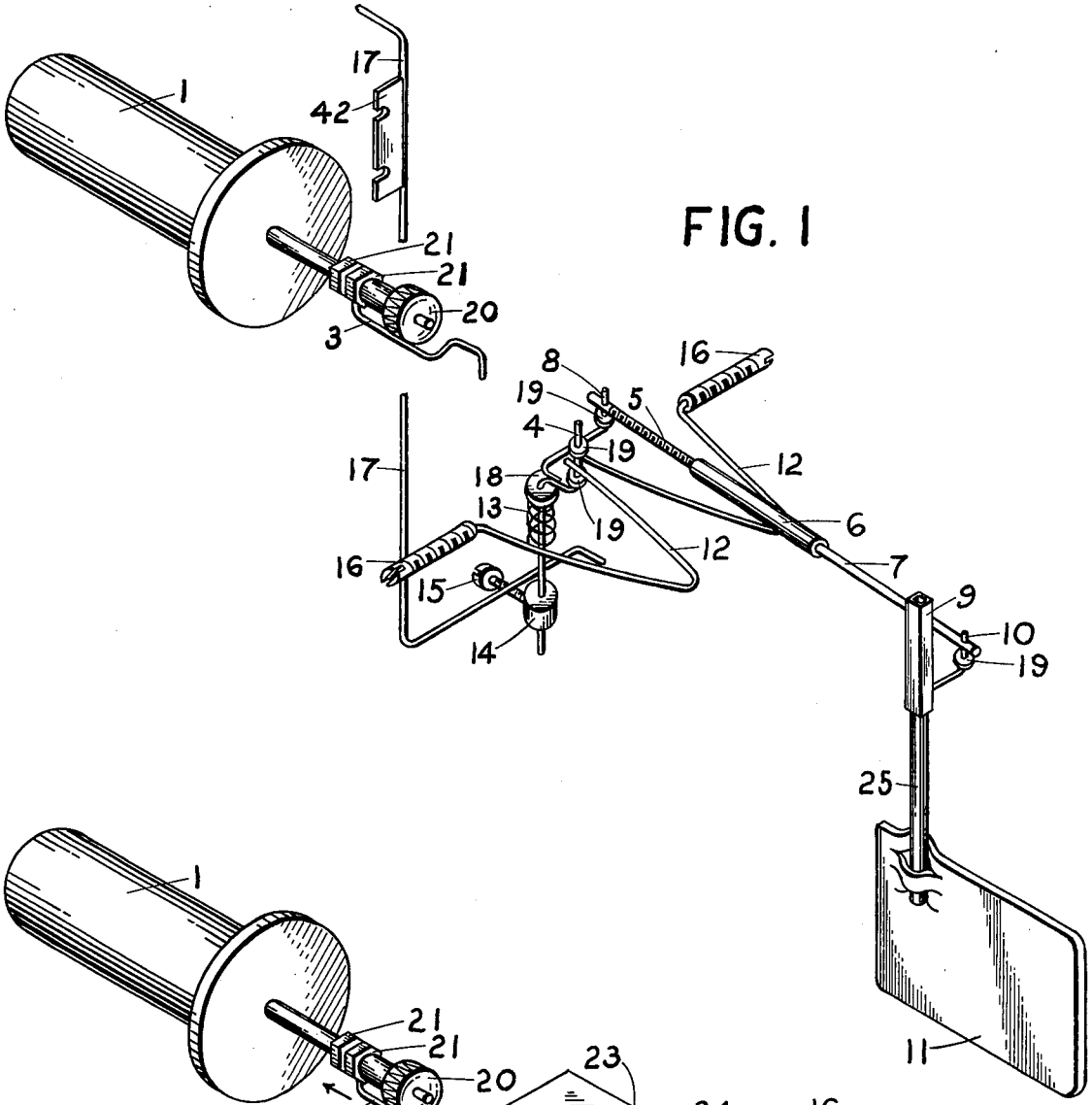
FIG. 1 is a perspective view of the time lapse steering control showing the moving parts of the mechanism and their relationhip to each other. All supporting and mounting structures are removed so the moving parts can be clearly seen.
Figure 2:
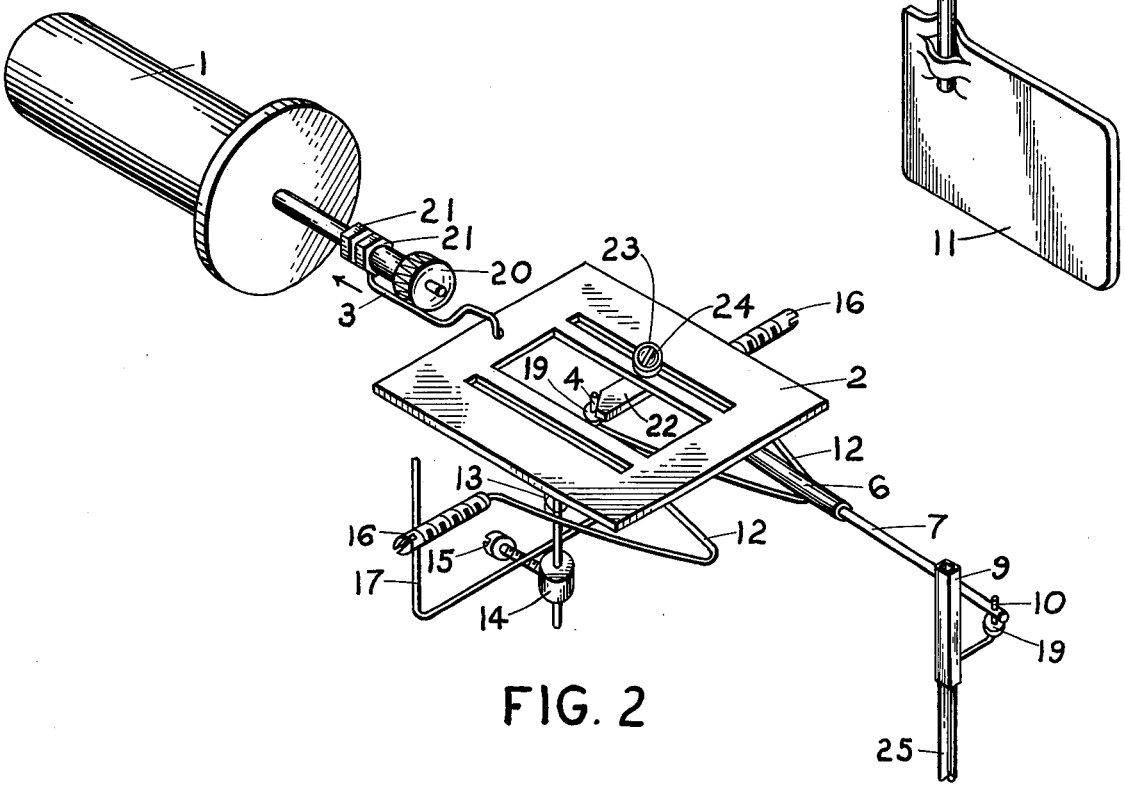
FIG. 2 is a perspective view identical to FIG. 1 with the exception that the cam plate and cam are shown in their relative positions in the mechanism.

The related linkage through which the timer 1, actuates the rudder on the boar is shown most clearly in FIGS. 1 and 2. As shown in FIG. 1, the cam follower 4, and lever arm 8, are made of piano wire bent to shape and soldered together to form a single unit. Also soldered in place on the cam follower-lever arm unit 4-8, are rings 19, cut from hollow tubing. These rings act as retainers to keep the threaded rod end 5, in place on the lever arm 8, and to keep the two centering springs 12, in place on the cam follower 4. As shown in FIGS. 3, 4, and 5, the cam follower-lever arm unit rotates about its axis in bearing holes located in item 34. The timer 1, acts to pull the cam plate 2, and its attached cam 22, past the cam follower 4. As shown in FIG. 11, the cam plate 2, is guided in its path toward the timer by two guide rails comprised of angle sections 31 and 32. The timer 1, is connected to the cam plate through the hook 3, shown in FIG. 2. The timer in FIG. 2 is shown in partially extended position, the arrow next to the piston rod indicating the direction of movement of the piston rod. As the cam plate 2, is drawn toward the timer 1, the inclined leading edge of cam 22; i.e. the cam face, engages the cam follower 4, pushing it to the side. This motion is transferred through the lever arm 8, to the link 5-6-7, and thereby to the rudder lever arm 10. The method of connecting the rudder lever arm 10, to the rudder shaft 25, is shown in FIG. 6. The lever arm 10, is made of piano wire bent to shape and soldered in position on the length of square tubing 9. A ring 19, is soldered in position on the lever arm to act as a retainer keeping rod end 7, in position. The square sleeve 9, slides over a mating section 26, on the rudder shaft 25. Thereby motion is transferred from the rudder lever arm 10, to the rudder 11.

Centering Springs

In FIG. 1, two centering springs 12, are shown. These springs oppose each other meeting as shown on the cam follower 4, and held in position there by the two retaining rings 19. The other end of the springs 12, fit loosely into holes drilled in the ends of adjusting screws 16. FIGS. 4 and 5 show these adjusting screws mounted in threaded holes in items 33. The two springs 12, act to keep the cam follower 4 and thereby the rudder 11, in a centered position. The adjusting screws 16 provide a means of adjusting the force exerted by the springs 12 on the cam follower 4, so it may be initially set in a centered position.

Supporting Structure

The supporting structue of the steering control device as shown in FIGS. 3, 4, 5, and 11, is generally comprised of plastic sections. The only exception is bracket 29, which is aluminum. Other materials could also be used to make up the structure, however, these were found to be suitable and easy to work with. Item 29 is an angle section which forms a bracket by which the timer 1, is joined to the remaining structure. Bracket 29, is joined to the timer by a pair of screws 27, and nuts 28. The guide rail units are made by gluing plastic angle section 32, to plastic angle section 31. Two guide rail units are required and are connected to bracket 29 by screws 27, and nuts 28. The two plastic box section pieces 33, which have threaded holes for receiving spring adjusting screws 16, are in turn glued to the angle sections 31. Plastic channel section 30, is glued in turn to the underside of the two box sections 33, thus yoking the two guide rail units 31-32 together. Item 34 is another plastic box section which has the bearing holes for the cam follower-lever arm unit 4-8. It is received into the channel section of item 30, and held in place by two screws 24. Screws 24 extend through washers 23, and the slot out in item 30, and into threaded holes in item 34. The purpose of the slot in item 30 is to allow item 34 to be slid from one side to another so the cam follower 4, can be located in a central position between guide rails 31. The four holes drilled in the outer edges of items 29 and 30 provide the means by which the steering control unit can be fastened inside the model.

Regulating Valve Adjustment

Item 3, which acts as a link to connect the piston rod of the timer 1, to the cam plate 2, also acts as a brake to maintain the setting of the regulating valve 20. Item 3, shown in detail in FIGS. 7 and 8, is clamped in position on the piston rod of the timer by sandwiching the end shown in FIG. 8, between two nuts 21. When clamped thus it bears against the knurled cylindrical surface of valve 20 keeping it at its setting. However, the setting can be changed by turning the valve with the fingers with sufficient force to overcome the retaining pressure of item 3.

Cocking Operation

To operate the steering control device, it is first necessary to pull the piston rod of the timer out to its fullest extent. In order to easily reach into an access portion of the model to do this, the lever comprised of items 35, 36, and 37 shown in FIG. 11 is used. This lever 35-36-37, also serves as a means of extending the piston rod without causing any disturbance to the setting of the regulating valve 20, since its prongs bear only against the bracket 29, and nut 21. This lever is comprised of two pronged ends 35 joined together by a rivet 36, and capable of pivoting on the axis of said rivet. A band spring 37, serves to keep the prongs in a normally closed position.

Detent Operation

In cocking the timer, the cam 22 is pushed backwards against the cam follower 4. To prevent any undue resistance from the cam follower, a detent mechanism is built into this device which depresses the cam follower so that is lies below the path of the cam permitting the cam and cam plate to move freely back to a cocked position.

The operaion of the first embodiment of this detent mechanism is shown most clearly in FIGS. 1, 5, and 14. The cam associated with this first embodiment is shown in FIGS. 9 and **9*a*. In FIGS. 1 and 5, washer 18 is shown soldered to the cam follower-lever arm unit 4-8. Spring 13, bears against the top of item 34 shown in FIG. 5 and pushed upward against the washer 18, keeping the cam follower-lever arm unit in a raised position. Set collar 14, is clamped onto the cam follower-lever arm shaft 4-8, by set screw 15. This set collar bears against the underside of the top surface of the box section 34, acting as a stop to maintain the desired height of the cam follower. The detent lever 17, passes over the set screw 15 and through bearing holes in item 34. These bearing holes are the pivot axis of detent lever 17. By bearing down on the top of the detent lever 17 in FIG. 1, the set screw 15 is depressed and with it the cam follower 4, and its associated linkage. The notched plate 42, shown in FIGS. 1 and 14 is soldered to detent lever 17. The lever 17 being made of piano wire has a natural flexibility. A wire rod fastened to the model would set inside one of the notches shown on item 42 and retain lever 17 in the desired position. The natural flexibility of the lever would permit its being reset from one position to another. As shown in FIG. 14, the notch indicated by "G"would refer to the depressed position of the cam follower. The notch indicated by "H" would refer to the released position where the detent lever 17 would be held raised above the set screw 15** so that it wouldn't introduce any friction into the operating mode of the cam follower.

In the second embodiment of the detent mechanism, the cam shown in FIGS. 10 and **10*a* would be used. This cam has an inclined notch out into the following edge of the cam. This inclined surface is indicted by the dotted line in FIG. 10. A corresponding incline could also be filed on the top edge of the cam follower facing the timer. During the cocking operation, these two inclined surfaces would act as ramps sliding over each other and in the process automatically depressing the cam follower 4 and its associated linkage. Once the cam 22 has passed over the cam follower 4, the spring 13** would automatically reset the cam follower in its raised operation position.

Cam and Cam Plate Assembly

The cam 22, and cam plate 2, are shown assembled in FIGS. 2,11, **13*a*. The cam plate 2 has a large central opening into which the cam 22 projects. The cam 22, shown in its two embodiments in FIGS. 9 and 9*a*, and 10 and 10*a*, has two lugs 38 which fit into the narrow slot on either side of the large opening in the cam plate. The cam thus can be slid into any position along the length of the narrow slots. Therefore, the time at which a turn occurs can also be varied by changing the position of the cam on the cam plate. When the desired position is located, the cam 22 is clamped to the cam plate 2 by a screw 24 passing through a washer 23**, and the slot in the cam plate into a threaded hole in the cam.

Because the inclined cam face is on one side of the cam only, a cam cannot be transferred from a slot on one side of the cam plate to a slot on the other side. Two sets of cams are needed each set having the cam face on the opposite edge of the cam. However, this requirement could be eliminated if the lugs 38 were located on the top side and the underside of the cam. The reason for having the cam face along only one edge of the cam is that a narrower cam can be made, and therefore more cams can be placed on the cam plate.

Connecting Link

The construction of the connecting link unit 5-6-7 accomplishes two aims:

1. It provides the fine adjustment needed to preposition the rudder in a straight line. This is accomplished by turning the threaded rod end 5 into or out of the threaded portion of the sleeve 6.
2. It permits the steering control unit to be adaptable to a variety of models. Since each model will require a different link length, the rod end 7, can be cut to whatever length is suitable and soldered into sleeve 6.

Assembly in Model

FIG. 12 shows one possible arrangement of the steering control unit in a boat 41. The propeller 40, and propeller shaft 39 are shown in their relationship to the steering control unit.

Steering Maneuver

FIG. 13 shows the course of travel which a boat having the cam configuration shown in FIG. 13*a* will follow. The letters indicated in FIG. 13*a* show the locations of the cam follower relative to the cam at the time which corresponds to the position of the boat in its course of travel shown in FIG. 13. Only one cam was shown in place on the cam plate in this example. However, it can be readily seen that more than one cam could be positioned on the cam plate thus providing a greater variety of maneuvers. Also, the dimensions of the cam could be varied to give a greater range of maneuvers.

As stated previously, the extent of the turn can also be altered by varying the rate at which air is bled from the timer. If the regulating valve 20 is adjusted so that air is bled more slowly from the timer, the cam follower 4 will take longer to pass over the cam face. Thus the rudder 11 will be actuated for a longer period of time, and a longer turning arc will be accomplished.

Although the described embodiments of this invention are shown applied to use as a time lapse steering control means for self propelled models, it is recognized that it could also be adapted to a variety of cam actuated mechanisms. The changes and modifications necessary to adapt this device to use in operating other cam actuate mechanisms will be obvious to anyone skilled in the art.

What is claimed as new and desired to be protected by Letters Patent is set forth in the appended claims.

I claim:

1. A time lapse steering control for self propelled model boats, cars, and airplanes, said steering control comprising:

a spring loaded dashpot, said dashpot acting as a timer to determine the instant when a turn will commence and the extent of the turn, and to provide power means to actuate the steering means of the model; said timer being equipped with a valve to regulate the rate at which fluid within the dashpot is forced through the timer;

a cam operatively linked to said timer to provide the actuating force for said steering means;

a cam follower acted on by said cam;

a lever arm fixed to and moving with said cam follower;

a supporting structure to which said timer, cam, and cam follower with fixedly attached lever arm are mounted to comprise an operative steering control unit; and a connecting link which transmits the motion of said lever arm fixedly attached to said cam follower, to a coresponding lever arm fixedly attached to said steering means of the model.

2. A combination as defined in claim 1 wherein said timer comprises a cylinder, spring actuated piston, hollow piston rod through which the sid fluid passes, and said fluid flow regulating valve on the outer end of said piston rod.

3. A combination as defined in claim 2 wherein a means is provided for holding said regulating valve at its desired setting by the use of a bent wire rod clamped to the piston rod of said timer and bearing against a knurled portion of said valve.

4. A combination as defined in claim 3 wherein said holding means for said regulating valve also has a hook on one end to engage said cam and operatively link it to said timer.

5. A combination as defined in claim 2 wherein a tool is used to facilitate said cocking mode; said tool having a configuration which enables the said piston rod to be extended without disturbing the setting of said regulating valve.

6. A combination as defined in claim 5 wherein said tool can reach into a restricted access portion of said model to effect the extending of said piston rod during said cocking operation.

7. A combination as defined in claim 1 wherein said cam is comprised of two parts; a cam plate, and a cam;

said cam plate being rectangular in shape and having a large rectangular center opening with one longitudinal guide slot on either side of said large center opening;

said cam having a cam face projecting into the large center opening of said cam plate and having means for moveably fixing said cam in said guide slots.

8. A combination as defined in claim 7 wherein two opposing springs push against the sides of said cam follower acting to keep it in a centered position within the large center opening in said cam plate; said cam follower being operatively moved only when acted on by said cam.

9. A combination as defined in claim 8 wherein said centering springs each have one end loosely fitted into holes drilled in the ends of adjusting screws; said screws acting to adjust the force exerted by said springs so that said cam follower can be preset in an initially centered position in the large center opening of said cam plate.

10. A combination as defined in claim 8 wherein a detent mechanism serves to depress said cam follower so that said cam plate and cam can be set in a cocked position with a minimum of resistance from said cam follower.

11. A combination as defined in claim 10 wherein a spring return operatively engages the said cam follower to oppose said detent mechanism and to return the said cam follower to its operating position on release of said detent mechanism.

12. A combination as defined in claim 11 wherein said detent mechanism is built into said cam and cam follower by cutting an inclined ramplike notch into the underside and following edge of said cam, and a mating ramplike edge on the top front edge of said cam follower; said ramplike surfaces sliding over each other during the cocking operation.

13. A combination as defined in claim 1 wherein said connecting link is comprised of one rod end which is threadedly attached in one end of a connecting sleeve; said threaded rod end serving to adjust the initial alignment of the steering means of the model; and a tubular rod end which is fixedly attached to the other end of said connecting sleeve; said tubular rod end capable of being cut ot whatever length suits the particular steering control installation.

* * * * *

UNITED STATES PATENT AND TRADEMARK OFFICE

CERTIFICATE OF CORRECTION

PATENT NO. : 4041886

DATED : August 16, 1977

INVENTOR(S) : Francis Knipp

It is certified that error appears in the above-identified patent and that said Letters Patent are hereby corrected as shown below:

In column 1, line 12 the word "has" should be --had--.

Line 12 would then read:

--series of turns after a certain preset period of time had--

In column 1, line 21 there should be a space between the word "a" and "steering". Line 21 would then read:

--linkage. This system provides a steering control unit--

In column 2, line 27 the word "boar" should read --boat--.

Line 27 would then read:

--ates the rudder on the boat is shown most clearly in--

In column 4, line 7 the word "pushed" should be --pushes--.

Line 7 would then read:

--pushes upward against the washer 18, keeping the cam--

In column 4, line 21 the word "set" should read --seat--.

Line 21 would then read:

--ity. A wire rod fastened to the model would seat inside--

UNITED STATES PATENT AND TRADEMARK OFFICE

CERTIFICATE OF CORRECTION

PATENT NO. : 4041886

DATED : August 16, 1977

INVENTOR(S) : Francis Knipp

It is certified that error appears in the above-identified patent and that said Letters Patent are hereby corrected as shown below:

In column 4, line 34 the word "out" should be --cut--.

Line 34 would then read:

--cam has an inclined notch cut into the following edge of--

In column 4, line 35 the word "indicted" should be

--indicated--. Line 35 would then read:

--the cam. This inclined surface is indicated by the dotted--

In column 4, lines 43 and 44, the word "operation" should be --operating--. Lines 43 and 44 would then read:

--automatically reset the cam follower in its raised operating position.--

In column 5, line 43 the word "actuate" should be

--actuated--. Line 43 would then read:

--actuated mechanisms will be obvious to anyone skilled in--

In column 6, line 3 the word "sid" should be --said--.

Line 3 would then read:

UNITED STATES PATENT AND TRADEMARK OFFICE

CERTIFICATE OF CORRECTION

PATENT NO. : 4041886

DATED : August 16, 1977

INVENTOR(S) : Francis Knipp

It is certified that error appears in the above-identified patent and that said Letters Patent are hereby corrected as shown below:

--low piston rod through which the said fluid passes and--

In column 6, line 66 the word "ot" should be --to--.

Line 66 would then read:

--being cut to whatever length suits the particular steer- --

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*